US010672372B2

(12) United States Patent
Okano

(10) Patent No.: US 10,672,372 B2
(45) Date of Patent: Jun. 2, 2020

(54) TONE SETTING DEVICE, ELECTRONIC MUSICAL INSTRUMENT SYSTEM, AND TONE SETTING METHOD

(71) Applicant: Yamaha Corporation, Hamamatsu-shi, Shizuoka (JP)

(72) Inventor: Tadashi Okano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/233,850

(22) Filed: Dec. 27, 2018

(65) Prior Publication Data

US 2019/0147840 A1 May 16, 2019

Related U.S. Application Data

(63) Continuation of application No. PCT/JP2017/023346, filed on Jun. 26, 2017.

(30) Foreign Application Priority Data

Jun. 28, 2016 (JP) ..... 2016-127619

(51) Int. Cl.
*G10H 1/24* (2006.01)
*G10H 1/00* (2006.01)

(52) U.S. Cl.
CPC ..... *G10H 1/24* (2013.01); *G10H 1/00* (2013.01); *G10H 1/0008* (2013.01)

(58) Field of Classification Search
CPC ..... G10H 1/24; G10H 1/00; G10H 1/0008
(Continued)

(56) References Cited

U.S. PATENT DOCUMENTS 5,412,154 A * 5/1995 Takeda ..... G10H 1/06 84/622
7,642,447 B2 * 1/2010 Kojima ..... G10H 1/0066 84/609

(Continued)

FOREIGN PATENT DOCUMENTS

JP 6-67666 A 3/1994
JP 7-230285 A 8/1995

(Continued)

OTHER PUBLICATIONS

International Search Report (PCT/ISA/210) issued in PCT Application No. PCT/JP2017/023346 dated Sep. 19, 2017 with English translation (five (5) pages).

(Continued)

*Primary Examiner* — David S Warren
*Assistant Examiner* — Christina M Schreiber
(74) *Attorney, Agent, or Firm* — Crowell & Moring LLP

(57) ABSTRACT

This tone setter comprises a memory for storing a program and a plurality of tone data; and at least one processor configured to utilize the plurality of tone data and set a sound source. In accordance with the program, the at least one processor executes accepting a selection of one or more tones made by an operation of a user; and setting, in at least an electronic musical instrument or a sound source of the tone setter, tone data corresponding to the selected one or more tones such that sound having the selected one or more tones is generatable with the musical instrument.

10 Claims, 12 Drawing Sheets

(58) Field of Classification Search
USPC ..... 84/609
See application file for complete search history.

(56) References Cited

U.S. PATENT DOCUMENTS

| | | | | |
|---|---|---|---|---|
| 7,795,525 | B2 * | 9/2010 | Sato | G10H 1/02 84/609 |
| 2002/0121180 | A1 * | 9/2002 | Kondo | G09B 15/04 84/609 |
| 2003/0101862 | A1 * | 6/2003 | Furukawa | G10F 1/02 84/610 |
| 2005/0159832 | A1 * | 7/2005 | Umeo | G08C 19/00 700/94 |
| 2009/0133567 | A1 * | 5/2009 | Okano | G10H 1/0066 84/609 |
| 2009/0145283 | A1 * | 6/2009 | Okano | G10H 1/0066 84/609 |
| 2009/0145287 | A1 * | 6/2009 | Okano | G10H 1/0066 84/645 |
| 2009/0307395 | A1 * | 12/2009 | Umeo | G08C 19/00 710/61 |
| 2010/0242710 | A1 * | 9/2010 | Ide | G10H 1/0066 84/622 |
| 2010/0306667 | A1 * | 12/2010 | Umeo | G08C 19/00 715/740 |
| 2012/0227573 | A1 * | 9/2012 | Nakagawa | G10H 1/053 84/624 |
| 2014/0093105 | A1 * | 4/2014 | Okano | G10H 5/02 381/124 |
| 2017/0249930 | A1 * | 8/2017 | Takehisa | G10H 1/24 |
| 2019/0147840 | A1 * | 5/2019 | Okano | G10H 1/0008 |

FOREIGN PATENT DOCUMENTS

| | | | |
|---|---|---|---|
| JP | 9-274487 | A | 10/1997 |
| JP | 2005-202138 | A | 7/2005 |
| JP | 2015-172771 | A | 10/2015 |
| JP | 2015172771 | A * | 10/2015 |

OTHER PUBLICATIONS

Japanese-language Written Opinion (PCT/ISA/237) issued in PCT Application No. PCT/JP2017/023346 dated Sep. 19, 2017 (four (4) pages).

Japanese-language Office Action issued in counterpart Japanese Application No. 2016-127619 dated Dec. 3, 2019 with English translation (five pages).

* cited by examiner

TONE SETTING DEVICE, ELECTRONIC MUSICAL INSTRUMENT SYSTEM, AND TONE SETTING METHOD

TECHNICAL FIELD

The present invention relates to a tone setter that sets a tone in an electronic musical instrument, and an electronic musical instrument system comprising the tone setter and a tone setting method.

BACKGROUND ART

In electronic musical instruments, a musical sound can be generated that has a layered tone (composite tone) obtained by combining a plurality of single tones. For example, in the electronic musical instrument described in PTL 1, tone data is formed that pertains to layered tones which is a combination of tone data pertaining to a layered tone and tone data pertaining to a single tone.

CITATION LIST

Patent Literature

Patent Literature 1: JP 06-67666A

SUMMARY

Technical Problem

In the aforementioned electronic musical instrument described in PTL 1, musical sound of a new layered tone formed by the user can be generated. However, there is a need to edit tone data of various types by using the electronic musical instrument in order to generate, with the electronic musical instrument, a musical sound of layered tones that uses tone data not set in the internal sound source of the electronic musical instrument.

The present invention according to one aspect was made in view of these circumstances and an object thereof is to provide a tone setter, a tone setting method, and an electronic musical instrument system that are capable of generating musical sound having various tones with a simple operation by using an electronic musical instrument.

Solution to Problem

The tone setter according to an aspect of the present invention is atone setter that is connectable to an electronic musical instrument and comprises: a memory for storing a plurality of tone data and a program; and at least one processor that is configured so as to utilize the plurality of tone data and perform setting of a sound source, wherein the at least one processor is configured to execute, in accordance with the program: accepting a selection of one or more tones by an operation of a user; and setting tone data corresponding to the selected one or more tones, in at least one of the sound source and the electronic musical instrument so that a sound having the selected one or more tones is generatable with the electronic musical instrument.

According to the tone setter, when the one or more tones are selected by a user, tone data corresponding to each tone can be set in at least one of the sound source unit and the electronic musical instrument so that it is possible to generate sound having the selected one or more tones with the electronic musical instrument. Therefore, it is possible to use the electronic musical instrument to generate musical sound having various tones with a simple (selection) operation of the tone setter.

In the tone setter according to above aspect, the at least one processor may be further configured to execute accepting a selection of a plurality of tones, and setting layered tone data corresponding to a layered tone or the tone data corresponding to each tone in at least one of the sound source and the electronic musical instrument so that sound having a layered sound obtained by combining the selected plurality of tones, is generatable using the electronic musical instrument. According to this configuration, it is possible to use the electronic musical instrument to generate music having various layered tones with a simple operation.

In the tone setter according to the above aspect, the selection of the one or more tones may include selecting a previously set layered tone. According to this configuration, various layered tones can be generated using an electronic musical instrument with a simple operation by selecting a layered tone set in the tone setter beforehand.

In the tone setter according to the above aspect, the at least one processor may be configured to determine whether to accept the selection of the previously set layered tone in accordance with presence or absence of an internal sound source of the electronic musical instrument connected to the tone setter or in accordance with tone data that is settable in the internal sound source. According to this configuration, the selection of a layered tone that cannot be used by the electronic musical instrument connected to the tone setter is not accepted, and the setting of a suitable tone for each connected electronic musical instrument is possible.

In the tone setter according to the above aspect, the at least one processor may be configured to accept the selection of a previously set layered tone when the tone setter is connected to a specific equipment type of electronic musical instrument. According to this configuration, by previously storing a rich variety of layered tones for each type of electronic musical instrument, a sound having more types of layered tones can be generated when the specific equipment type of electronic musical instrument is connected to the tone setter. As a result, the use of a specific equipment type of electronic musical instrument is encouraged.

In the tone setter according to the above aspect, when tone data corresponding to the selected one or more tones is settable in the sound source, the at least one processor may set the tone data in the sound source. According to this configuration, musical sound based on tone data that is settable in a sound source can be generated by the electronic musical instrument. As a result, the types of tones of the musical sound that can be generated by the electronic musical instrument can be enriched.

In the tone setter according to the above aspect, the electronic musical instrument may include an internal sound source, and when the at least one processor accepts the selection of a plurality of tones, and the plurality of tone data corresponding to the selected plurality of tones includes first tone data that is settable in the sound source and second tone data that is settable in the internal sound source of the electronic musical instrument, the at least one processor may set the first tone data in the sound source and may set the second tone data in the internal sound source of the electronic musical instrument. According to this configuration, musical sound based on a combination of tone data that can be used in the tone setter and tone data that can be used in the electronic musical instrument, can be generated by the electronic musical instrument. As a result, the types of tones of the musical sound that can be generated by the electronic musical instrument can be enriched.

In the tone setter according to the above aspect, the electronic musical instrument may include the internal sound source, and when tone data corresponding to the selected one or more tones is settable in the internal sound source of the electronic musical instrument, the at least one processor may set the tone data in the internal sound source of the electronic musical instrument. According to this configuration, musical sound having the specified tone can be generated by the electronic musical instrument with a simple operation of the tone setter.

An electronic musical instrument system according to an aspect of the present invention comprises an electronic musical instrument and a tone setter that can be connected to the electronic musical instrument, wherein the electronic musical instrument includes an operating unit that a user operates for making a sounding instruction, and a sound generator configured so as to generate a sound based on the sounding instruction, and the tone setter comprises: a memory for storing a program and a plurality of tone data; and at least one processor that is configured so as to utilize the plurality of tone data and perform setting of the sound source; the at least one processor is configured to execute, in accordance with the program: accepting a selection of one or a plurality tones by an operation of a user; and setting tone data corresponding to the selected one or more tones, in at least one of the sound source and the electronic musical instrument, so that a sound having the selected one or more tones can be generated by the sound generator of the electronic musical instrument.

According to the electronic musical instrument system, when one or more tones are selected by a user, tone data corresponding to each tone can be set in at least one of the sound source unit of the tone setter and the electronic musical instrument so that it is possible to generate sound having the selected one or more tones with the electronic musical instrument. Therefore, it is possible to use the electronic musical instrument to generate musical sound having various tones with a simple (selection) operation of the tone setter.

A tone setting method according to an aspect of the present invention is a tone setting method performed with a tone setter that is connectable to an electronic musical instrument, the method including: accepting a selection of one or more tones by an operation of the user; and setting tone data corresponding to the selected one or more tones, in at least one of the sound source of the tone setter and the electronic musical instrument so that a sound having the selected one or more tones is generatable with the electronic musical instrument.

According to the tone setting method, when one or more tones are selected by a user, tone data corresponding to each tone can be set in at least one of the sound source unit of the tone setter and the electronic musical instrument so that it is possible to generate sound having the selected one or more tones with the electronic musical instrument. Therefore, it is possible to use the electronic musical instrument to generate musical sound having various tones with a simple (selection) operation of the tone setter.

Advantageous Effects

According to the present invention, it is possible to generate, with the electronic musical instrument, sound having various tones with a simple operation of the tone setter.

DESCRIPTION OF EMBODIMENTS

(1) Configuration of Electronic Musical Instrument System

Figure 1:
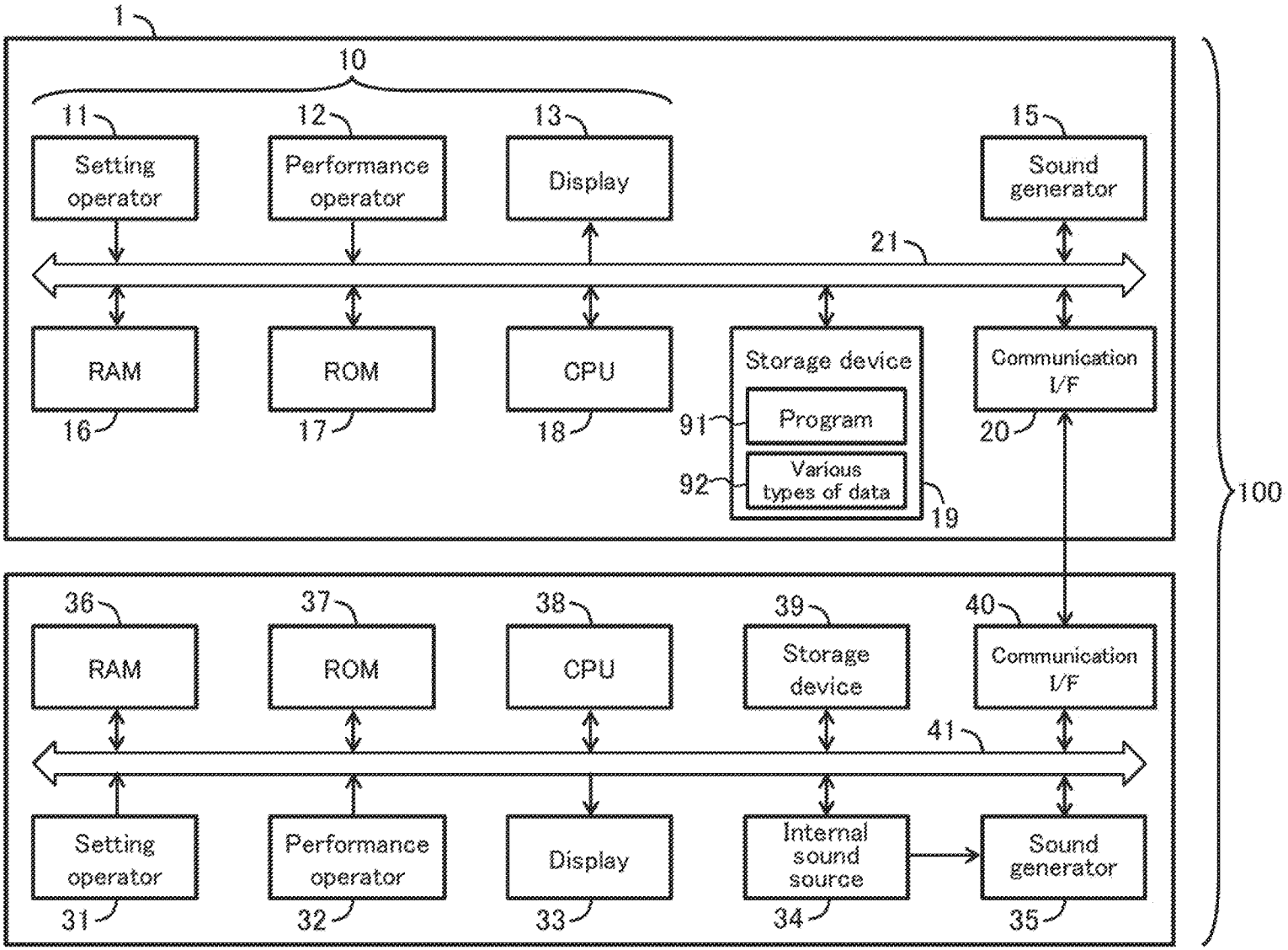
FIG. 1 is a block diagram schematically illustrating a configuration of an electronic musical instrument including a tone setter according to a first embodiment of the present invention.

FIG. 1 is a block diagram schematically illustrating a configuration of an electronic musical instrument system including a tone setter according to a first embodiment of the present invention. An electronic musical instrument system. 100 according to the present embodiment is configured by a tone setter 1 and an electronic musical instrument 3. A user is able to perform and compose music such as musical piece compositions with the electronic musical instrument 3. In addition, the user is able to set a variety of tones in the electronic musical instrument 3 with the tone setter 1. Note that a tone is one characteristic of sound. By setting a specific tone in a sound source, an acoustic signal having the set tone is generatable by the sound source.

(1-1) Hardware Configuration of Tone Setter

The tone setter 1 comprises a setting operator 11, a performance operator 12, a display 13, a sound generator 15, a random access memory (RAM) 16, a read only memory (ROM) 17, a central processing unit (CPU) 18, a storage device 19, and a communication interface (I/F) 20. The setting operator 11 may be, for example, a switch that is switched on and off, a rotary encoder that is rotated, a linear encoder that is operated by sliding, or the like. The setting operator 11 is used for adjusting various parameters, selecting various types of data, turning the power on and off, and the like. The performance operator 12 includes, for example, a keyboard, a drum pad, or the like. The display 13 displays a below-mentioned tone selection menu and various types of information. In the present embodiment, the setting operator 11, the performance operator 12, and the display 13 are configured by a touch panel display 10. That is, the setting operator 11 and the performance operator 12 are displayed as graphical user interfaces (GUI) on the screen of the touch panel display 10. The user is able to perform various operations such as selecting a tone and the like with the touch panel display 10.

The RAM 16 is configured, for example, with a volatile memory and is used as a work region of the CPU 18. When executing tone setting processing, a plurality of tone data is held in the RAM 16. The ROM 17 is configured, for example, by a non-volatile memory and stores a computer program such as a system program. A plurality of previously set tone data may be stored in the ROM 17.

The storage device 19 is configured, for example, by at least any storage medium such as a hard disk drive, a solid-state drive, an optical disk, a magnetic disc, or a memory card. A tone setting program (described as "program" in FIG. 1) 91 for performing below-mentioned tone setting processing, and various types of data 92 including the plurality of tone data utilized in the tone setting processing, and the like are stored in the storage device 19. The tone setting program 91 and the plurality of tone data may be stored in the ROM 17, and the CPU 18 may acquire the tone setting program 91 and the tone data from the ROM 17.

The CPU 18 sets a sound source unit (below-mentioned sound source unit 14) that creates an acoustic signal and performs tone setting processing by executing the tone setting program 91 stored in the storage device 19 on the RAM 16. Details are described below. The CPU 18 corresponds to a "processor" in the present invention and the RAM 16, the ROM 17, and the storage device 19 correspond to the "memory" in the present invention.

The sound generator 15 includes, for example, a digital/analog (D/A) conversion circuit, an amplifier, and a speaker. The sound generator 15 converts an acoustic signal created by the sound source unit to an analog sound signal and generates a musical sound based on the analog sound signal. The acoustic signal is a digital signal comprising a plurality of sampling values that represent a wave form of sound having various pitches and various tones.

The communication I/F 20 includes a communication driver and a communication connector that correspond to a connected target (for example, a communication network, an external device), and transmits and receives various commands, various requests, and acoustic signals. For example, the communication I/F 20 includes a universal serial bus (USB) driver and a USB connector. The USB driver includes a musical instrument digital interface (MIDI) driver for controlling the input and output of MIDI events (MIDI signals), and an audio driver for controlling the input and output of the acoustic signals. The touch panel display 10, the sound generator 15, the RAM 16, the ROM 17, the CPU 18, the storage device 19, and the communication I/F 20 are connected via a bus 21.

With regard to the detailed hardware configuration of the tone setter 1, configuration elements may be omitted, substituted, or added as appropriate in accordance with the embodiments. For example, the tone setter 1 may include a plurality of CPUs. In addition, the CPU 18 may be configured by a microprocessor, a field-programmable gate array (FPGA), or the like. The storage device 19 may be omitted if the storage regions in the RAM 16 and the ROM 17 are sufficient. In addition to an information processing device designed for a provided dedicated service, a general computer such as a smartphone or other mobile terminal, a desktop computer (personal computer), or a tablet PC, and the like may be used for the tone setter 1.

In addition, the tone setting program 91 may be provided while stored on a computer-readable recording medium, or may be installed in the ROM 17 or the storage device 19. In addition, when the communication I/F 20 is connected to a communication network, a tone setting program 91 distributed from a server connected to the communication network may be installed in the ROM 17 or the storage device 19.

(1-2) Hardware Configuration of Electronic Musical Instrument

The electronic musical instrument 3 comprises a setting operator 31, a performance operator 32, a display 33, an internal sound source 34, a sound generator 35, a RAM 36, a ROM 37, a CPU 38, a storage device 39, and a communication I/F 40. The setting operator 31, the performance operator 32, the display 33, the internal sound source 34, the sound generator 35, the RAM 36, the ROM 37, the CPU 38, the storage device 39, and the communication I/F 40 are all connected via a bus 41.

The functions and configurations of the setting operator 31, the performance operator 32, the display 33, and the sound generator 35 of the electronic musical instrument 3 are respectively the same as the functions and configurations of the setting operator 11, the performance operator 12, the display 13, and the sound generator 15 of the tone setter 1. However, the above configuration elements of the electronic musical instrument 3 do not necessarily match those of the tone setter 1 exactly.

While the setting operator 31, the performance operator 32, and the display 33 may be configured by a touch panel display in the same way as the tone setter 1, in the present embodiment, the setting operator 31 is not a GUI and is configured by a physical switch, rotary encoder, or linear encoder. In addition, the performance operator 32 in the present embodiment is not a GUI and includes a physical keyboard, drum pad, or the like. Various types of information is displayed on the display 33.

The internal sound source 34 includes, for example, a pulse code modulation (PCM) sound source, or the like, and creates an acoustic signal. The internal sound source 34 is configured, for example, by a microcomputer and a memory such as a RAM, a ROM, or the like. The sound generator 35 converts an acoustic signal created by the sound source unit 34 to an analog sound signal and generates a musical sound based on the analog sound signal.

The RAM 36 is configured, for example, with a volatile memory and is used as a work region of the CPU 38. A plurality of tone data may be held in the RAM 36. The ROM 37 is configured, for example, by a non-volatile memory and stores a computer program such as a system program, an operation program, or the like. A plurality of previously set tone data may be stored in the ROM 37. The CPU 38 executes an operation program stored in the ROM 37 on the RAM 36. The storage device 39 is configured, for example, by at least any storage medium such as a hard disk drive, a solid-state drive, an optical disk, a magnetic disc, or a memory card. The plurality of tone data and the operation program may be stored in the storage device 39.

The communication I/F 40 includes a communication driver and a communication connector that correspond to a connected target (for example, a communication network, an external device), and transmits and receives various commands, various requests, and acoustic signals. For example, the communication I/F 40 includes a USB driver and a USB connector in the same way as the communication I/F 20. The USB driver includes a MIDI driver and an audio driver. The communication I/F 40 is connected to the communication I/F 20 of the tone setter 1 by using a USB cable or the like.

(2) Software Configuration of Tone Setter 1

Figure 2:
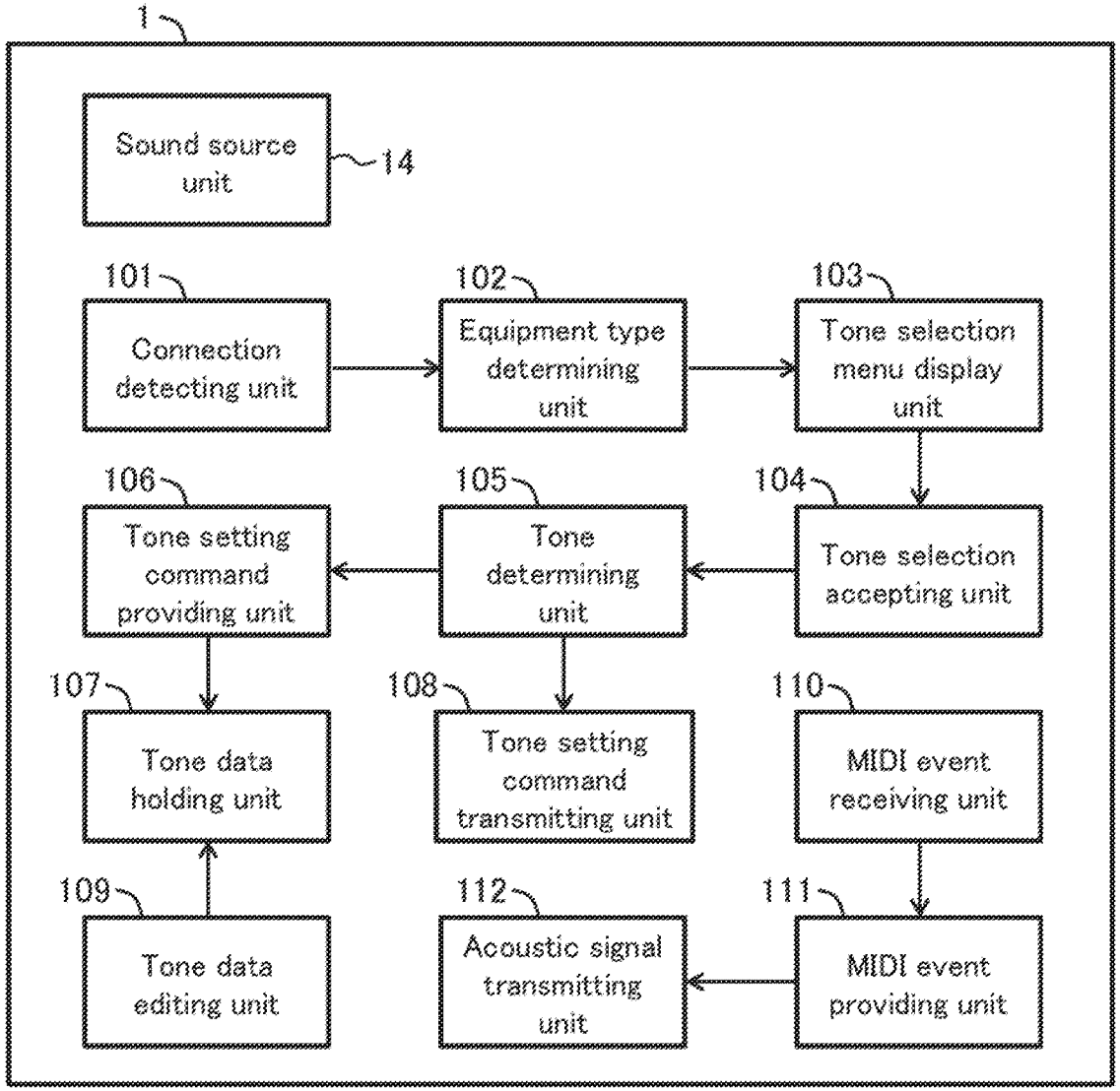
FIG. 2 is a block diagram of a functional configuration of the tone setter in FIG. 1.

FIG. 2 is a block diagram showing a software configuration of the tone setter 1 in FIG. 1. The CPU 18 of the tone setter 1 develops the tone setting program 91 stored in the storage device 19, to the RAM 16. The CPU 18 then interprets the tone setting program 91 developed in the RAM 16 and executes various types of information processing. Consequently, as shown in FIG. 2, the tone setter 1 functions as a computer comprising the sound source unit 14, a connection detecting unit 101, an equipment type determining unit 102, a tone selection menu display unit 103, a tone selection accepting unit 104, a tone determining unit 105, a tone setting command providing unit 106, a tone data holding unit 107, a tone setting command transmitting unit 108, a tone data editing unit 109, a MIDI event receiving unit 110, a MIDI event providing unit 111, and an acoustic signal transmitting unit 112.

The sound source unit 14 accepts the setting of a tone and creates an acoustic signal (audio signal) of a sound (musical sound) having the set tone. The CPU 18 utilizes the plurality of tone data and sets the tone of the sound source unit 14. The sound source unit 14 corresponds to a "sound source" of the tone setter of the present invention.

The connection detecting unit 101 detects whether or not the electronic musical instrument 3 is connected to the communication I/F 20 in FIG. 1. The equipment type determining unit 102 determines the type of equipment of the electronic musical instrument 3 connected to the communication I/F 20. The tone selection menu display unit 103 causes a below-mentioned tone selection menu to be displayed on the display 13 in FIG. 1. The tone selection accepting unit 104 accepts a selection made by using the setting operator 11 in FIG. 1 of a tone from the tone selection menu. The tone determining unit 105 determines whether the selected tone is a tone that is settable in the sound source unit 14 of the tone setter 1 or is settable in the internal sound source 34 of the electronic musical instrument 3. The tone setting command providing unit 106 provides a tone setting command to the tone data holding unit 107 when the selected tone is a tone that is settable in the sound source unit 14 of the tone setter 1. The tone data holding unit 107 is configured by at least any portion of a storage region of the RAM 16, the ROM 17, or the storage device 19 in FIG. 1. The tone data holding unit 107 holds a plurality of layered tone data and a plurality of single tone data.

Here, the layered tone data is a tone obtained by combining a plurality of single tone data. The tone data pertaining to layered tones is called layered tone data and the tone data pertaining to single tones is called single tone data. In the following explanation, the layered tone data and the single tone data are collectively referred to as tone data as appropriate. The tone data is configured by a plurality of acoustic effect parameters. The plurality of acoustic effect parameters are classified into a plurality of acoustic effect types. For example, "filter," "envelope," "oscillator," "low frequency oscillator (LFO)," and the like are known as acoustic effect types. As for "filter" acoustic effect parameters, there are "Cutoff", "resonance", "envelope generator depth (EG depth)", "LFO depth", and the like. As for "envelope" acoustic effect parameters, there are "Attack", "decay", "sustain", "release", and the like.

The tone data editing unit 109 creates new layered tone data or new single tone data by editing the tone data held in the tone data holding unit 107 on the basis of an operation of the setting operator 11 by a user. The aforementioned tone data holding unit 107 has a preset data region and a user data region. The plurality of tone data (preset tone data) is previously stored in the preset data region. Tone data (user tone data) made with the tone data editing unit 109 is stored in the user data region.

The tone setting command transmitting unit 108 transmits a tone setting command to the electronic musical instrument 3 via the communication I/F 20 when the selected tone is a tone that is settable in the internal sound source 34 of the electronic musical instrument 3.

The MIDI event receiving unit 110 receives a MIDI event from the electronic musical instrument 3 via the communication I/F 20. The MIDI event providing unit 111 provides the received MIDI event to the sound source unit 14. The acoustic signal transmitting unit 112 transmits an acoustic signal created by the sound source unit 14 to the electronic musical instrument 3 via the communication I/F 20.

In the present embodiment, the functions of the tone setter 1 are all realized by a general CPU (CPU 18). However, some or all of the above functions may be realized by one or more dedicated processors. For example, the sound source unit 14 may not be realized by software and may be realized by hardware separate from the CPU 18, the RAM 16, or the like. As an example, the sound source unit 14 may be configured by a microcomputer and a memory such as a RAM or a ROM, and may include a frequency modulation (FM) sound source or the like. Moreover, with regard to the functional configuration of the tone setter 1, functions may be omitted, substituted, or added as appropriate in accordance with the embodiments.

(3) Tone Selection Menu

Figure 3:
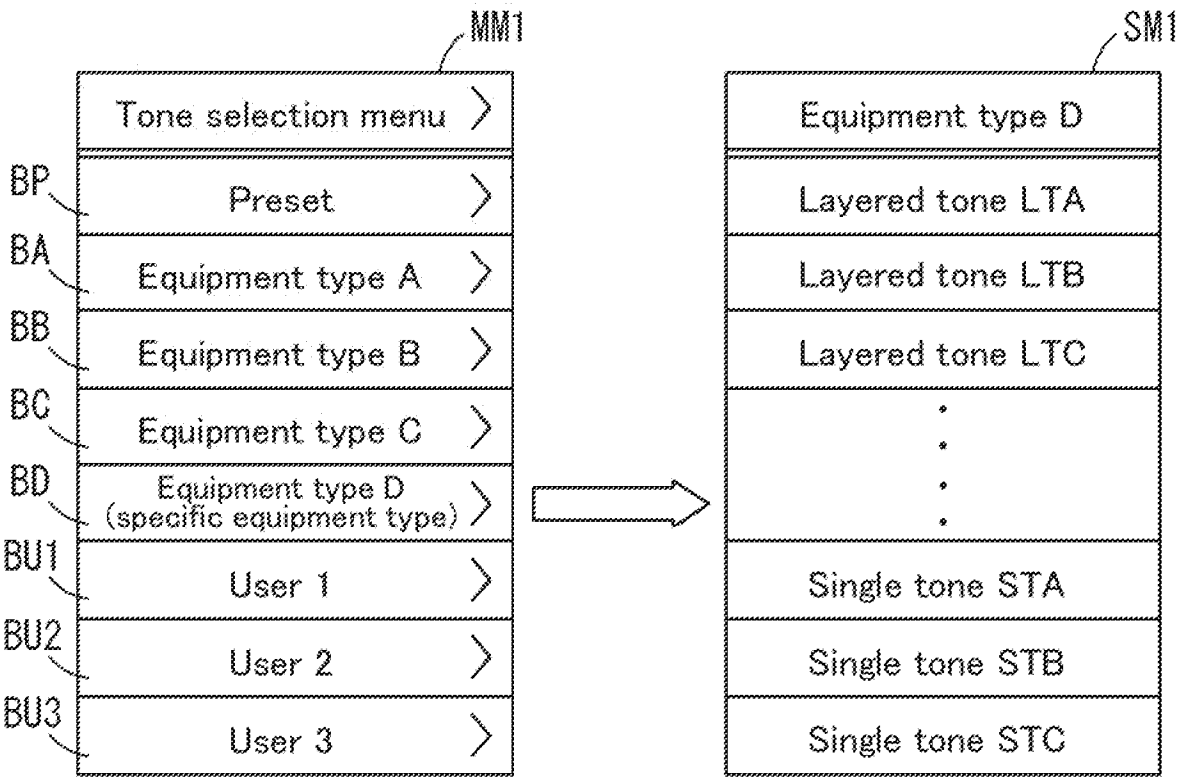
FIG. 3 is a schematic view of an example of a tone selection menu displayed by the display in FIG. 1.

FIG. 3 is a schematic view of an example of a tone selection menu displayed by the display 13 in FIG. 1. FIG. 3 illustrates the tone selection menu (referred to as a tone selection menu for specific equipment types) displayed when a specific equipment type of electronic musical instrument 3 is connected to the tone setter 1. In the present embodiment, an equipment type D is the specific equipment type. Therefore, the tone selection menu of FIG. 3 is displayed on the display 13 when the electronic musical instrument 3 of the equipment type D is connected to the tone setter 1.

The tone selection menu for the specific equipment type in FIG. 3 includes a main menu MM1 and a plurality of submenus. A plurality of tone banks are displayed in the main menu MM1. In the example in FIG. 3, the main menu MM1 has a preset bank BP, an equipment type A bank BA, an equipment type B bank BB, an equipment type C bank BC, an equipment type D bank BD, a user 1 bank BU1, a user 2 bank BU2, and a user 3 bank BU3. The preset bank BP includes a plurality of tone data previously stored in the tone data holding unit 107 of the tone setter 1. The equipment type A bank BA, the equipment type B bank BB, the equipment type C bank BC, and the equipment type D bank BD respectively include a plurality of tone data that are the same as the plurality of tone data previously stored in the electronic musical instruments 3 of the equipment types A, B, C, and D. The user 1 bank BU1, the user 2 bank BU2, and the user 3 bank BU3 respectively include one or a plurality of tone data made by the user by editing.

The submenus are prepared respectively corresponding to each of the banks BP, BA, BB, BC, BD, BU1, BU2, and BU3. A submenu SM1 corresponding to the equipment type D bank BD is illustrated in FIG. 3. A plurality of layered tones LTA, LTB, and LTC, and a plurality of single tones STA, STB, and STC are represented in the submenu SM1. The user is able to select a layered tone or a single tone in the submenu SM1. In this way, when an electronic musical instrument 3 of a specific equipment type (equipment type D in the present example) is connected to the tone setter 1, the user is able to select a layered tone or a single tone in the banks BP, BA, BB, BC, BD, BU1, BU2, and BU3 displayed on the tone selection menu of the specific equipment type in FIG. 3. The one or more tones that can be selected from the tone selection menu for the specific equipment type in FIG. 3 include, a tone that is settable in the sound source unit 14 of the tone setter 1, a tone that is settable in the internal sound source 34 of the electronic musical instrument 3, and a layered tone in which a tone that is settable in the sound source unit 14 of the tone setter 1 and a tone that is settable in the internal sound source 34 of the electronic musical instrument 3 are combined.

Figure 4:
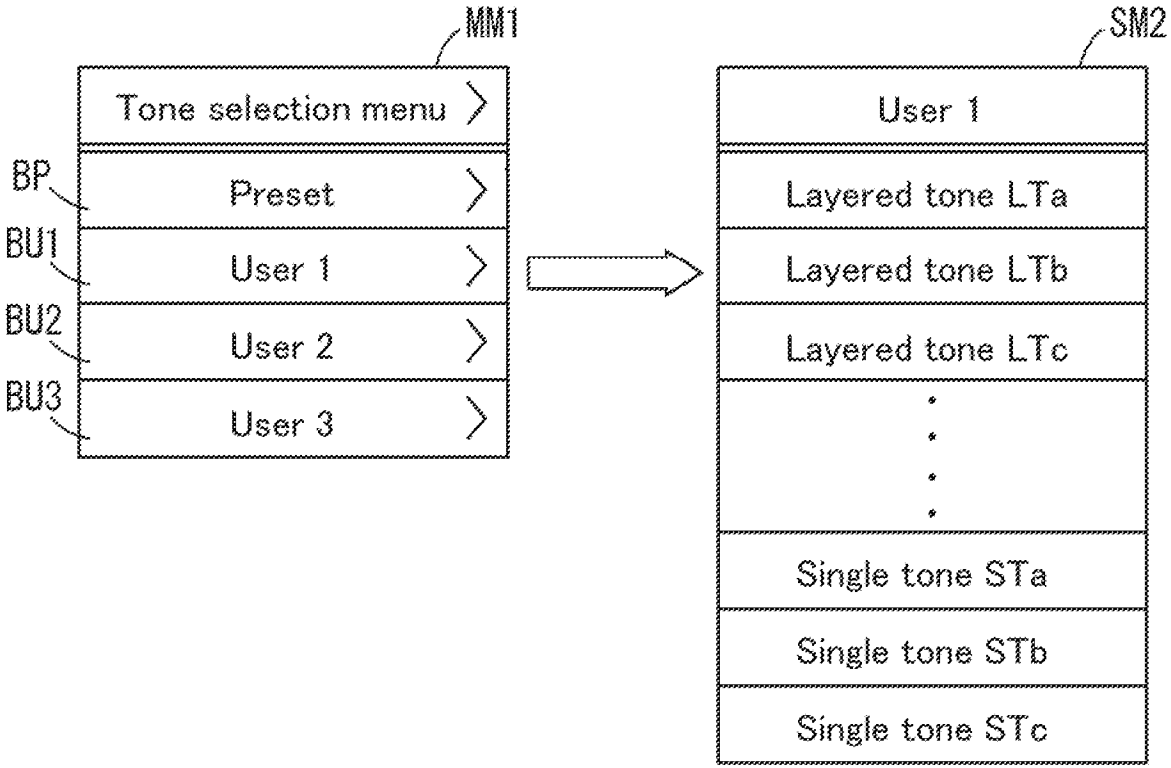
FIG. 4 is a schematic view of another example of the tone selection menu displayed by the display in FIG. 1.

FIG. 4 is a schematic view of another example of the tone selection menu displayed by the display 13 in FIG. 1. FIG. 4 illustrates the tone selection menu (referred to below as tone selection menu) displayed when a standard equipment type of electronic musical instrument 3 is connected to the tone setter 1. The tone selection menu for standard equipment types in FIG. 4 includes a main menu MM2 and a plurality of submenus. In the example in FIG. 4, the main menu MM2 has the preset bank BP, the user 1 bank BU1, the user 2 bank BU2, and the user 3 bank BU3, and the equipment type A bank BA, the equipment type B bank BB, the equipment type C bank BC, and the equipment type D bank BD of FIG. 3 are omitted. A submenu SM2 corresponding to the preset bank BP is illustrated in FIG. 4. A plurality of layered tones LTa, LTb, and LTc, and a plurality of single tones STa, STb, and STc are displayed in the submenu SM2. In this way, when an electronic musical instrument 3 of a standard equipment type is connected to the tone setter 1, the user is able to select a layered tone or a single tone in the banks BP, BU1, BU2, and BU3 displayed on the tone selection menu for the standard equipment type in FIG. 4. The one or more tones that can be selected from the tone selection menu for the specific equipment type in FIG. 4 includes, a tone that is settable in the sound source unit 14 of the tone setter 1, a tone that is settable in the internal sound source 34 of the electronic musical instrument 3, and a layered tone in which a tone that is settable in the sound source unit 14 of the tone setter 1 and a tone that is settable in the internal sound source 34 of the electronic musical instrument 3 are combined. For example, a tone of a general MIDI (GM) sound source may be used as the above layered tone or single tone.

(4) Tone Setting Operation

Figure 5:
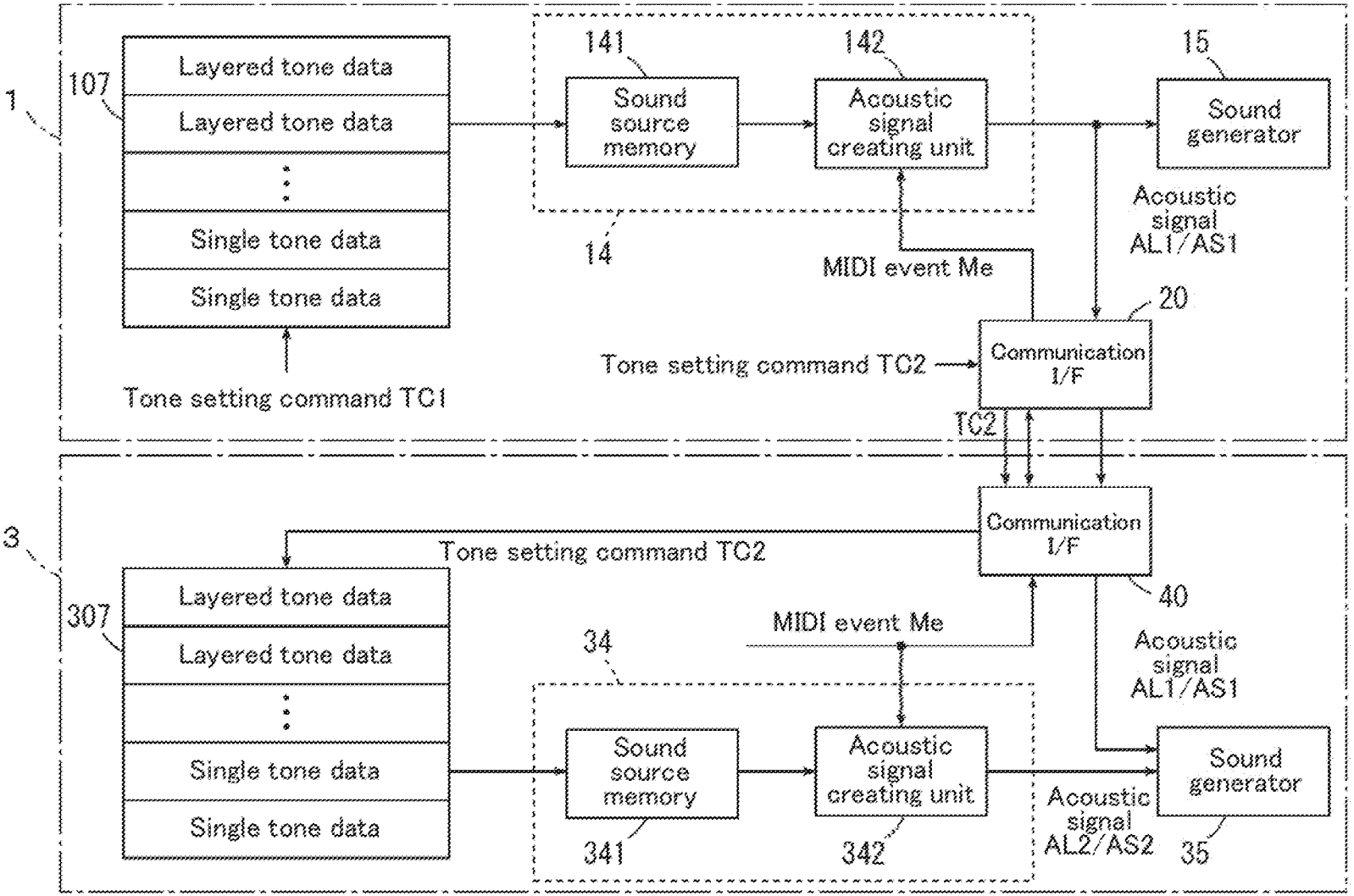
FIG. 5 is a block diagram for explaining a tone setting operation by the tone setter in FIG. 1.

FIG. 5 is a block diagram for explaining a tone setting operation by the tone setter 1 in FIG. 1. A portion of the configuration elements of the tone setter 1 and the electronic musical instrument 3 are illustrated in FIG. 5.

The tone setter 1 includes the tone data holding unit 107 illustrated in FIG. 2. The tone data holding unit 107 holds the plurality of layered tone data and the plurality of single tone data. The sound source unit 14 includes a sound source memory 141 and an acoustic signal creating unit 142. The sound source memory 141 is configured by at least any portion of a storage region of the RAM 16 and the storage device 19. The acoustic signal creating unit 142 is configured by the CPU 18. The sound source unit 14 has a plurality of channels (for example, 16 channels). The sound source memory 141 is able to store, in each channel, the tone data selected from the layered tone data or the single tone data held in the tone data holding unit 107. The acoustic signal creating unit 142 creates an acoustic signal based on the tone data stored in the sound source memory 141 in each channel. Setting the tone data in the sound source unit 14 signifies establishing a state in which the tone data is stored in the sound source memory 141 and an acoustic signal based on the stored tone data can be created by the acoustic signal creating unit 142. The tone data held by the tone data holding unit 107 is settable in the sound source memory 141. The setting of tones in the sound source unit 14 can be performed by setting the tone data in the sound source memory 141.

The electronic musical instrument 3 includes a tone data holding unit 307. The tone data holding unit 307 is configured by at least any portion of a storage region of any of the RAM 36, the ROM 37, and the storage device 39 in FIG. 1. The plurality of layered tone data and the plurality of single tone data is previously held in the tone data holding unit 307. The internal sound source 34 includes a sound source memory 341 and an acoustic signal creating unit 342. The sound source memory 341 is configured by a RAM or the like. The acoustic signal creating unit 342 is configured by a microcomputer or the like. The internal sound source 34 has a plurality of channels (for example, 16 channels). The sound source memory 341 is able to store, in each channel, the tone data selected from the layered tone data or the single tone data stored in the tone data holding unit 307. The acoustic signal creating unit 342 creates an acoustic signal based on the tone data stored in the sound source memory 341 in each channel. Setting the tone data in the internal sound source 34 signifies establishing a state in which the tone data is stored in the sound source memory 341 and an acoustic signal based on the stored tone data can be created by the acoustic signal creating unit 342. The tone data held by the tone data holding unit 307 is settable in the sound source memory 341. The setting of tones in the internal sound source 34 can be performed by setting the tone data in the sound source memory 341.

The following is an explanation of first, second, and third operation examples of the tone setter 1 and the electronic musical instrument 3 when the sound generator 35 of the electronic musical instrument 3 generates musical sound having a layered tone.

The first operation example is an operation example performed when a layered tone selected by a user is settable in the sound source unit 14 of the tone setter 1. In this case, a tone setting command TC1 is generated in the tone setter 1. The tone setting command TC1 is provided to the tone data holding unit 107 of the tone setter 1. As a result, the layered tone data pertaining to the selected layered tone is bulk transferred from the tone data holding unit 107 to the sound source memory 141 of the sound source unit 14. When a MIDI event Me is generated in the electronic musical instrument 3, the MIDI event Me is provided via the communication I/F 40 and the communication I/F 20 to the acoustic signal creating unit 142 of the sound source unit 14 of the tone setter 1. If the MIDI event Me is a note-on event, the acoustic signal creating unit 142 creates an acoustic signal AL1 that has the layered tone based on the layered tone data stored in the sound source memory 141 and has the pitch specified by the note-on event. The acoustic signal AL1 is provided via the communication I/F 20 and the communication I/F to the sound generator 35 of the electronic musical instrument 3. As a result, a musical sound having the layered tone based on the acoustic signal AL1 is generated from the sound generator 35.

The second operation example is an operation example performed when a layered tone selected by a user is a combination of a tone that is settable in the sound source unit 14 of the tone setter 1 and a tone that is settable in the internal sound source 34 of the electronic musical instrument 3. In this case, the tone setting command TC1 and a tone setting command TC2 are generated in the tone setter 1. The tone setting command TC1 is provided to the tone data holding unit 107 of the tone setter 1, and the tone setting command TC2 is provided via the communication I/F 20 and the communication I/F 40 to the tone data holding unit 307 of the electronic musical instrument 3. As a result, the tone data pertaining to the tone selected in the tone setter 1 is bulk transferred from the tone data holding unit 107 to the sound source memory 141 of the sound source unit 14, and the tone data pertaining to the tone selected in the electronic musical instrument 3 is bulk transferred from the tone data holding unit 307 to the sound source memory 341 of the internal sound source 34.

When a MIDI event Me is generated in the electronic musical instrument 3, the MIDI event Me is provided to the acoustic signal creating unit 342 and is provided via the communication I/F 40 and the communication I/F 20 to the acoustic signal creating unit 142 of the sound source unit 14 of the tone setter 1. If the MIDI event Me is a note-on event, the acoustic signal creating unit 142 creates an acoustic signal AS1 that has the tone based on the tone data stored in the sound source memory 141 and has the pitch specified by the note-on event. The acoustic signal AS1 is provided via the communication I/F 20 and the communication I/F 40 to the sound generator 35 of the electronic musical instrument 3. On the other hand, the acoustic signal creating unit 342 of the electronic musical instrument 3 creates an acoustic signal AS2 that has the tone based on the tone data stored in the sound source memory 341 and has the pitch specified by the note-on event. The acoustic signal AS2 is provided to the sound generator 35. As a result, a musical sound having the layered tone based on the acoustic signals AS1 and AS2 is generated from the sound generator 35.

The third operation example is an operation example performed when a layered tone selected by a user is a layered tone that is settable in the internal sound source 34 of the electronic musical instrument 3. In this case, the tone setting command TC2 is generated in the tone setter 1. The tone setting command TC2 is provided via the communication I/F 20 and the communication I/F 40 to the tone data holding unit 307 of the electronic musical instrument 3. As a result, the selected layered tone data is bulk transferred from the tone data holding unit 307 to the sound source memory 341 of the internal sound source 34. When a MIDI event Me is generated in the electronic musical instrument 3, the MIDI event Me is provided to the acoustic signal creating unit 342. If the MIDI event Me is a note-on event, the acoustic signal creating unit 342 creates an acoustic signal AL2 that has the layered tone based on the layered tone data stored in the sound source memory 341 and has the pitch specified by the note-on event. The acoustic signal AL2 is provided to the sound generator 35 of the electronic musical instrument 3. As a result, a musical sound having the layered tone based on the acoustic signal AL2 is generated from the sound generator 35.

(5) Tone Setting Processing by Tone Setter 1

Figure 6:
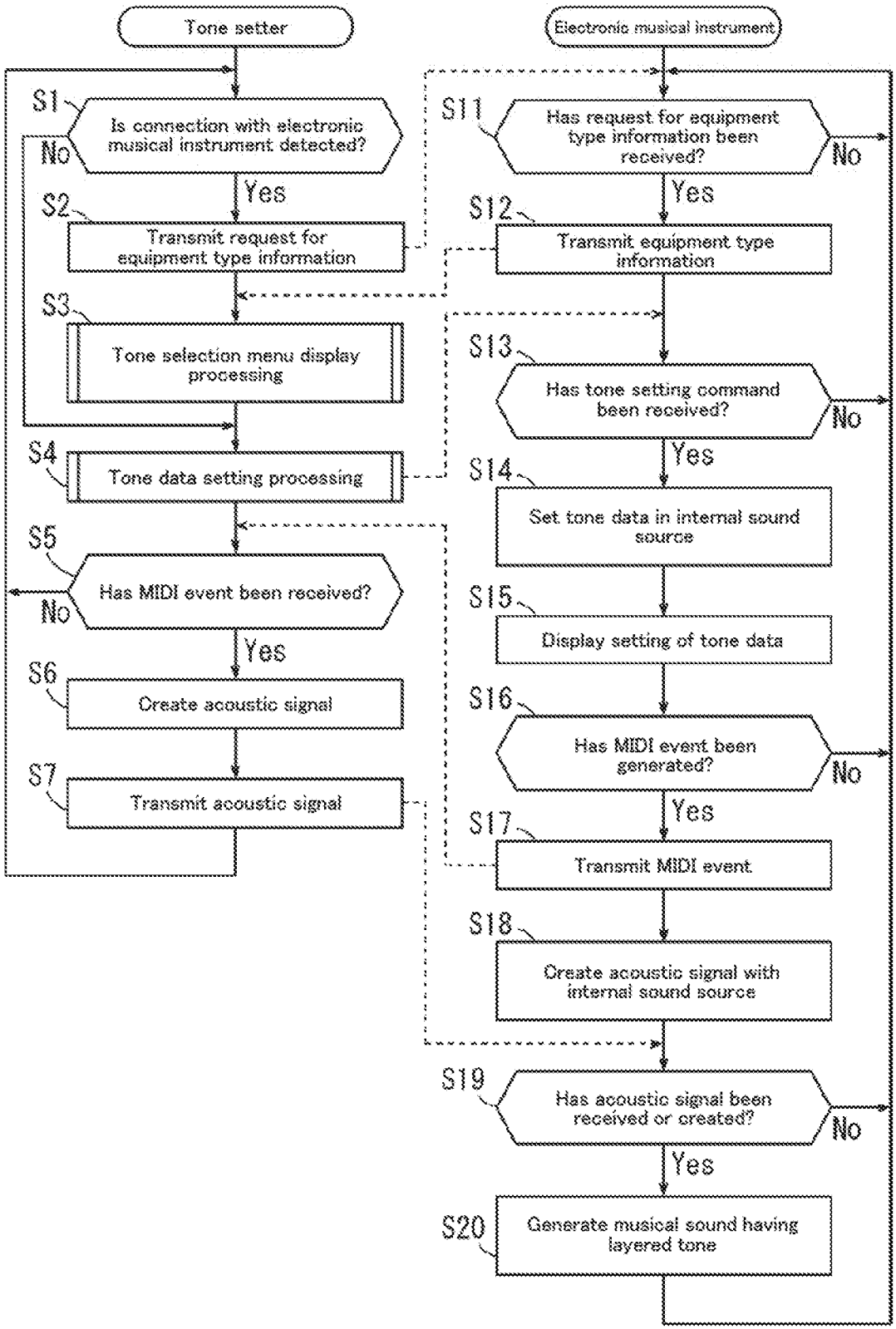
FIG. 6 is a flow chart of tone setting processing by the tone setter.
Figure 7:
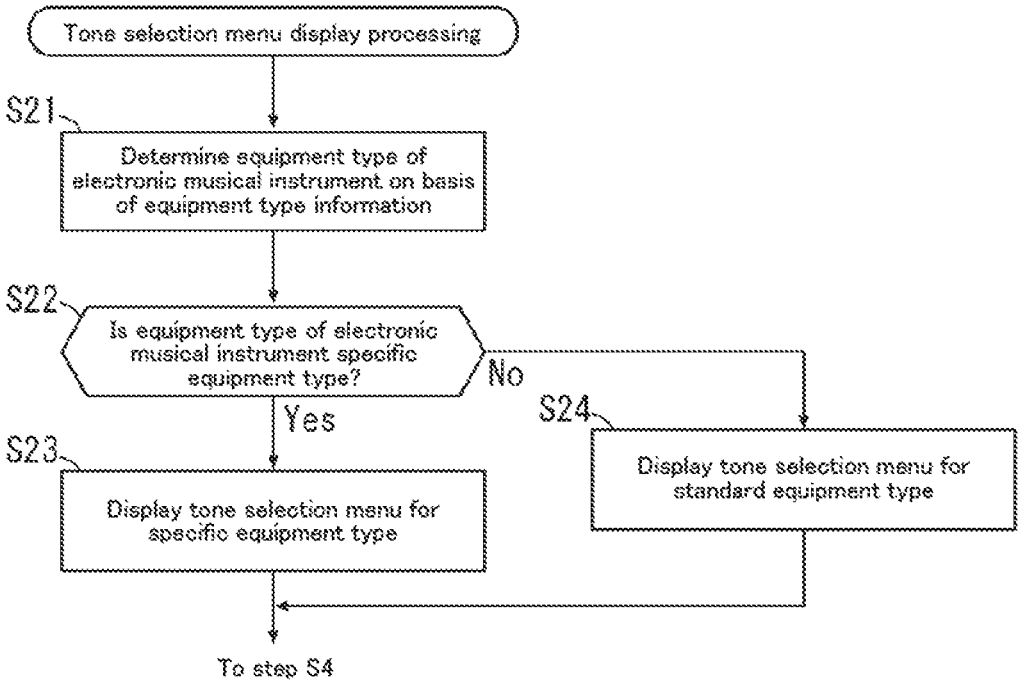
FIG. 7 is a flow chart of tone selection menu display processing.
Figure 8:
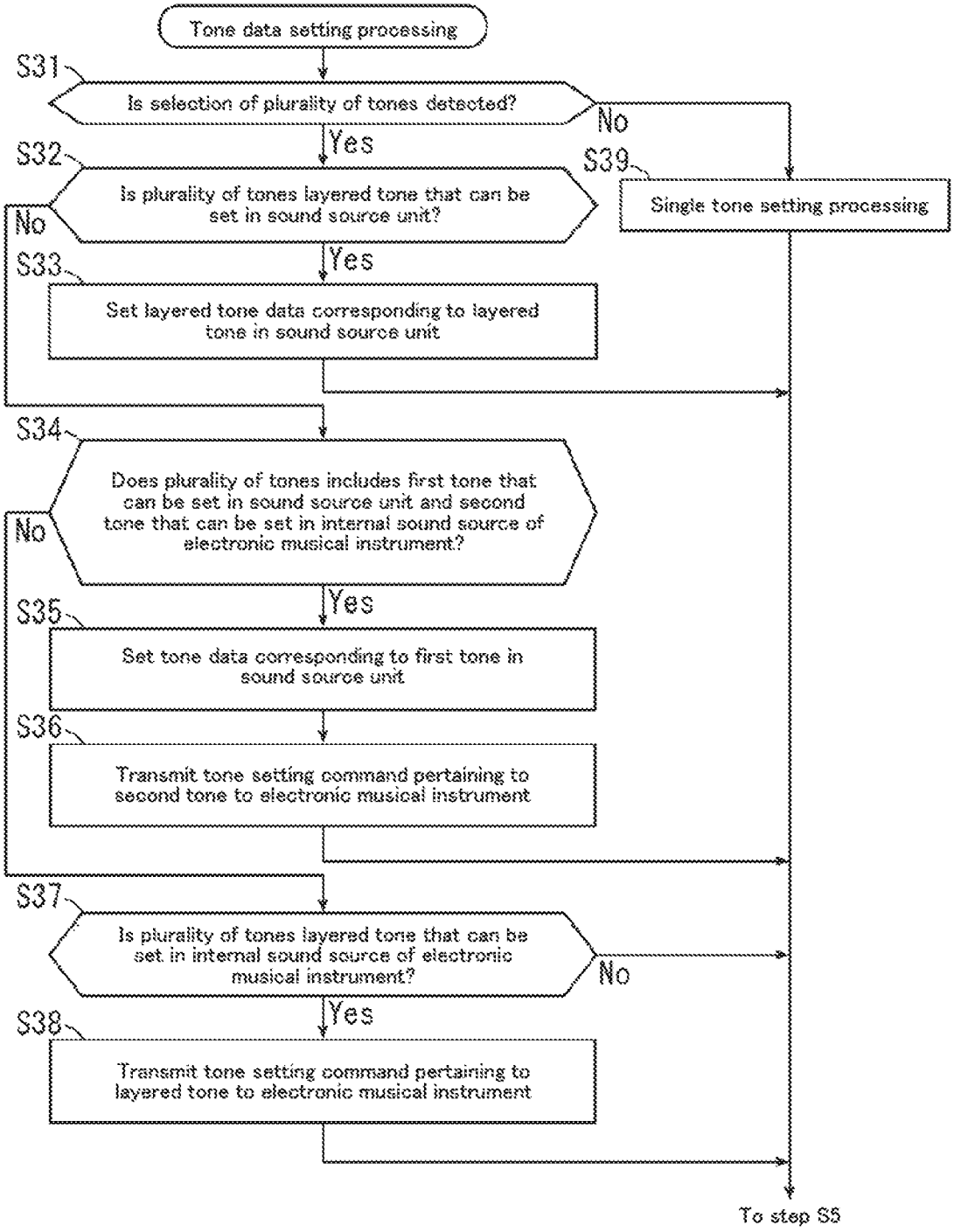
FIG. 8 is a flow chart of tone data setting processing.

FIG. 6 is a flow chart of tone setting processing by the tone setter 1. FIG. 7 is a flow chart of tone selection menu display processing, and FIG. 8 is a flow chart of tone data setting processing. The CPU 18 of the tone setter 1 executes the following processing depicted in FIGS. 6 to 8 in accordance with the tone setting program 91 stored in the ROM 17 or the storage device 19. In addition, the CPU 38 of the electronic musical instrument 3 executes the following processing in accordance with the operation program stored in the ROM 37 or the storage device 39.

First, the CPU 18 functions as the connection detecting unit 101 and detects whether the electronic musical instrument 3 is connected to the tone setter 1 on the basis of the status of the communication I/F 20 in FIG. 1 (step S1). If the electronic musical instrument 3 is connected to the tone setter 1 (step S1: Yes), the CPU 18 transmits a request for equipment type information to the electronic musical instrument 3 (step S2). The equipment type information indicates at least the equipment type of the electronic musical instrument 3 in this case. On the other hand, if the electronic musical instrument 3 is not connected to the tone setter 1 (step S1: No), the CPU 18 advances the processing to step S4.

When the CPU 38 of the electronic musical instrument 3 receives the request for the equipment type information from the tone setter 1 (step S11: Yes), the CPU 38 transmits the equipment type information to the tone setter 1 (step S12). The equipment type information is stored, for example, in the ROM 37 or the storage device 39. However, if no request for the equipment type information is received (step S11: No), the CPU 38 waits until a request for the equipment type information is received.

When the CPU 18 of the tone setter 1 receives the equipment type information from the electronic musical instrument 3, the CPU 18 executes the tone selection menu display processing illustrated in FIG. 7 (step S3).

In the tone selection menu display processing in FIG. 7, the CPU 18 first functions as the equipment type determining unit 102 and determines the equipment type of the electronic musical instrument 3 on the basis of the equipment type information (step S21). If the equipment type of the electronic musical instrument 3 is a specific equipment type (equipment type D in this example), the CPU 18 functions as the tone selection menu display unit 103, displays the tone selection menu for the specific equipment type illustrated in FIG. 3 on the display 13 in FIG. 1 (step S23), and advances the processing to step S4 in FIG. 6. However, if the equipment type of the electronic musical instrument 3 is a standard equipment type, the CPU 18 functions as the tone selection menu display unit 103, displays the tone selection menu for the standard equipment type illustrated in FIG. 4 on the display 13 in FIG. 1 (step S24), and advances the processing to step S4 in FIG. 6.

The tone data setting processing illustrated in FIG. 8 is carried out in step S4 in FIG. 6. In the tone data setting processing in FIG. 8, the user selects a tone from the tone selection menu displayed on the display 13. The CPU 18 functions as the tone selection accepting unit 104 and accepts the selection of one or more tones by the user. In addition, the CPU 18 functions as the tone determining unit 105 and determines whether a plurality of tones has been selected (step S31). The selection of a plurality of tones in this case is the selection of a layered tone or the selection of a plurality of single tones.

When a plurality of tones has been selected, the CPU 18 functions as the tone determining unit 105 and determines whether the plurality of tones is a layered tone that is settable in the sound source unit 14 (step S32). If the plurality of tones is a layered tone that is settable in the sound source unit 14, the CPU 18 functions as the tone setting command providing unit 106 and sets the layered tone data corresponding to the selected layered tone in the sound source unit 14 (step S33). Specifically, the CPU 18 provides the tone setting command TC1 to the tone data holding unit 107 so that the layered tone data corresponding to the selected layered tone is transferred to the sound source memory 141 of the sound source unit 14. As a result, the layered tone data is transferred from the tone data holding unit 107 to the sound source memory 141. Consequently, the layered tone data is set in the sound source unit 14. Thereafter, the CPU 18 advances the processing to step S5 in FIG. 6.

If the plurality of tones in step S32 is not a layered tone that is settable in the sound source unit 14, the CPU 18 functions as the tone determining unit 105 and determines whether the plurality of tones includes a tone that is settable in the sound source unit 14 (referred to below as a first tone) and a tone that is settable in the internal sound source 34 of the electronic musical instrument 3 (referred to below as a second tone) (step S34). Here, the plurality of tones is the first and second tones combined as a layered tone, or first and second tones that are separate from each other (single tones or layered tones). If the plurality of tones includes the first tone and the second tone, the CPU 18 functions as the tone setting command providing unit 106 and sets the tone data corresponding to the first tone in the sound source unit 14 (step S35). Specifically, the CPU 18 provides the tone setting command TC1 to the tone data holding unit 107 so that the tone data corresponding to the selected first tone is transferred to the sound source memory 141 of the sound source unit 14. As a result, the tone data is transferred from the tone data holding unit 107 to the sound source memory 141. In addition, the CPU 18 functions as the tone setting command transmitting unit 108 and transmits the tone setting command TC2 pertaining to the second tone to the electronic musical instrument 3 (step S36). Specifically, the CPU 18 transmits the tone setting command TC2 to the electronic musical instrument 3 so that the tone data corresponding to the selected second tone is transferred to the sound source memory 341 of the internal sound source 34. As a result, the tone data is transferred from the tone data holding unit 307 of the electronic musical instrument 3 to the sound source memory 341. Thereafter, the CPU 18 advances the processing to step S5 in FIG. 6.

When the plurality of tone data does not include the first tone and the second tone in step S34, the tone determining unit 105 determines whether the selected plurality of tones is a layered tone that is settable in the internal sound source 34 of the electronic musical instrument 3 (step S37). If the selected plurality of tones is a layered tone that is settable in the internal sound source 34 of the electronic musical instrument 3, the CPU 18 functions as the tone setting command transmitting unit 108 and transmits the tone setting command TC2 pertaining to the layered tone to the electronic musical instrument 3 (step S38). Specifically, the CPU 18 transmits the tone setting command TC2 to the electronic musical instrument 3 so that the layered tone data corresponding to the selected layered tone is transferred to the sound source memory 341 of the internal sound source 34. As a result, the layered tone data is transferred from the tone data holding unit 307 of the electronic musical instrument 3 to the sound source memory 341. If the plurality of tones in step S37 is not a layered tone that is settable in the internal sound source 34 of the electronic musical instrument 3, the CPU 18 advances the processing to step S5 in FIG. 6.

If the plurality of tones is not selected in step S31, the single tone setting processing is carried out (step S39). In this case, the CPU 18 functions as the tone setting command providing unit 106 and provides, to the sound source unit 14, a tone setting command pertaining to the selected single tone. In addition, the CPU 18 functions as the tone setting command transmitting unit 108 and transmits, to the electronic musical instrument 3, the tone setting command pertaining to the selected single tone.

Conversely, in step S13 in FIG. 6, the CPU 38 in the electronic musical instrument 3 determines whether the tone setting command has been received from the tone setter 1. If the tone setting command has been received from the tone setter 1 (step S13: Yes), the CPU 38 sets the tone data (single tone data or layered tone data) in the internal sound source 34 on the basis of the tone setting command (step S14). In the second operation example, the tone data corresponding to the first tone is transferred from the tone data holding unit 307 of the electronic musical instrument 3 to the sound source memory 341. In the third operation example, the layered tone data corresponding to the layered tone is transferred from the tone data holding unit 307 of the electronic musical instrument 3 to the sound source memory 341. Furthermore, the CPU 38 displays the fact that the tone data has been set on the display 33 (step S15). Conversely, if no tone setting command has been received (step S13: No), the CPU 38 waits until a tone setting command is received or returns the processing to step S11.

Next, the CPU 38 of the electronic musical instrument 3 determines whether a MIDI event has been generated by an operation of the performance operator 32 (step S16). In this example, the MIDI event is a note-on event that includes a sounding instruction and a pitch. When a MIDI event is generated (step S16: Yes), the CPU 38 transmits the MIDI event to the tone setter 1 and the internal sound source 34 (step S17). Conversely, if no MIDI event is generated (step S16: No), the CPU 38 waits until a MIDI event is generated or returns the processing to step S11.

Next, the internal sound source 34 of the electronic musical instrument 3 responds to the MIDI event and creates an acoustic signal having a tone based on the set tone data, and the pitch specified by the MIDI event (step S18).

On the other hand, the CPU 18 of the tone setter 1 functions as the MIDI event receiving unit 110 and determines whether a MIDI event has been received from the electronic musical instrument 3 (step S5). If a MIDI event has been received (step S5: Yes), the CPU 18 functions as the MIDI event providing unit 111 and provides the MIDI event to the sound source unit 14. As a result, the CPU 18 functions as the acoustic signal creating unit 142 and creates the acoustic signal having the tone based on the tone data set in the sound source memory 141 and the pitch specified by the MIDI event (step S6). Next, the CPU 18 functions as the acoustic signal transmitting unit 112 and transmits the acoustic signal to the electronic musical instrument 3 (step S7), and waits until the reception of another MIDI event or returns the processing to step S1. If no MIDI event is received (step S5: No), the CPU 18 waits until a MIDI event is received, or returns the processing to step S1.

The CPU 38 of the electronic musical instrument 3 determines whether an acoustic signal has been created by the internal sound source 34 or whether an acoustic signal has been received from the tone setter 1 (step S19). When an acoustic signal has been created or received, the sound generator 35 generates a musical sound having the selected one or more tones on the basis of the acoustic signal (step S20). For example, in the case where the acoustic signal has been created by the internal sound source 34, the CPU 38 uses the sound generator 35 to generate a musical sound having the selected one or more tones on the basis of the acoustic signal created by the internal sound source 34. In the case where the acoustic signal has been received from the tone setter 1 for example, the CPU 38 uses the sound generator 35 to generate a musical sound having the selected one or more tones on the basis of the acoustic signal created by the tone setter 1. In the case where acoustic signals have been created by both the tone setter 1 and the internal sound source 34 for example, the CPU 38 uses the sound generator 35 to generate a musical sound having the selected one or more tones on the basis of both of the acoustic signals. According to the above, the tone data corresponding to the selected one or more tones can be set (steps S4 and S14) in at least one of the sound source unit 14 and the internal sound source 34 in the electronic musical instrument 3, so that the CPU 18 of the tone setter 1 is able to generate, with the electronic musical instrument 3, a sound (musical sound) having the one or more tones selected by the user. In step S20, a sound (musical sound) having the one or more tones selected by the user can then be generated with the electronic musical instrument 3.

(6) Effects of Embodiment

According to the tone setter 1 according to the present embodiment, the user is able to select, from a tone selection menu, one or more tones based on tone data that is settable in the sound source unit 14. As a result, the user is able to generate, with the electronic musical instrument 3, a musical sound having the one or more tones prepared in the tone setter 1.

In addition, according to the tone setter 1 according to the present embodiment, the user is able to select, from the tone selection menu, a layered tone based on a combination of tone data that is settable in the sound source unit 14 of the tone setter 1 and tone data that is settable in the internal sound source 34 of the electronic musical instrument 3. As a result, the user is able to generate, with the electronic musical instrument 3, a musical sound having the layered tone based on a combination of a tone prepared in the tone setter 1 and a tone prepared in the electronic musical instrument 3.

In addition, according to the tone setter 1 according to the present embodiment, the user is able to select, from the tone selection menu, one or more tones based on tone data that is settable in the internal sound source 34 of the electronic musical instrument 3. As a result, the user is able to generate, with the electronic musical instrument 3, a musical sound having the one or more tones prepared in the electronic musical instrument 3. Therefore, the user is able to generate, with the electronic musical instrument 3, a musical sound having various tones with a simple operation of the tone setter 1.

In addition, when the electronic musical instrument 3 of a specific equipment type can be connected to the tone setter 1, the user is able to select a layered tone that can be used with a variety of electronic musical instruments 3 from the tone selection menu for the specific equipment type. As a result, the user is able to generate a musical sound of multiple types of layered sounds with the specific equipment type of the electronic musical instrument 3 due to an abundant amount of types of layered tones being previously prepared for each type of the electronic musical instrument 3. Accordingly, the use of the specific equipment type of the electronic musical instrument 3 can be encouraged.

(7) Other Embodiments (a) In the above embodiment, the electronic musical instrument 3 has the internal sound source 34. However, the tone setter 1 can be applied to an electronic musical instrument that does not have an internal sound source. In this case, a musical sound can be generated with the electronic musical instrument on the basis of the tone data set in the sound source unit 14 of the tone setter 1.

Figure 9:
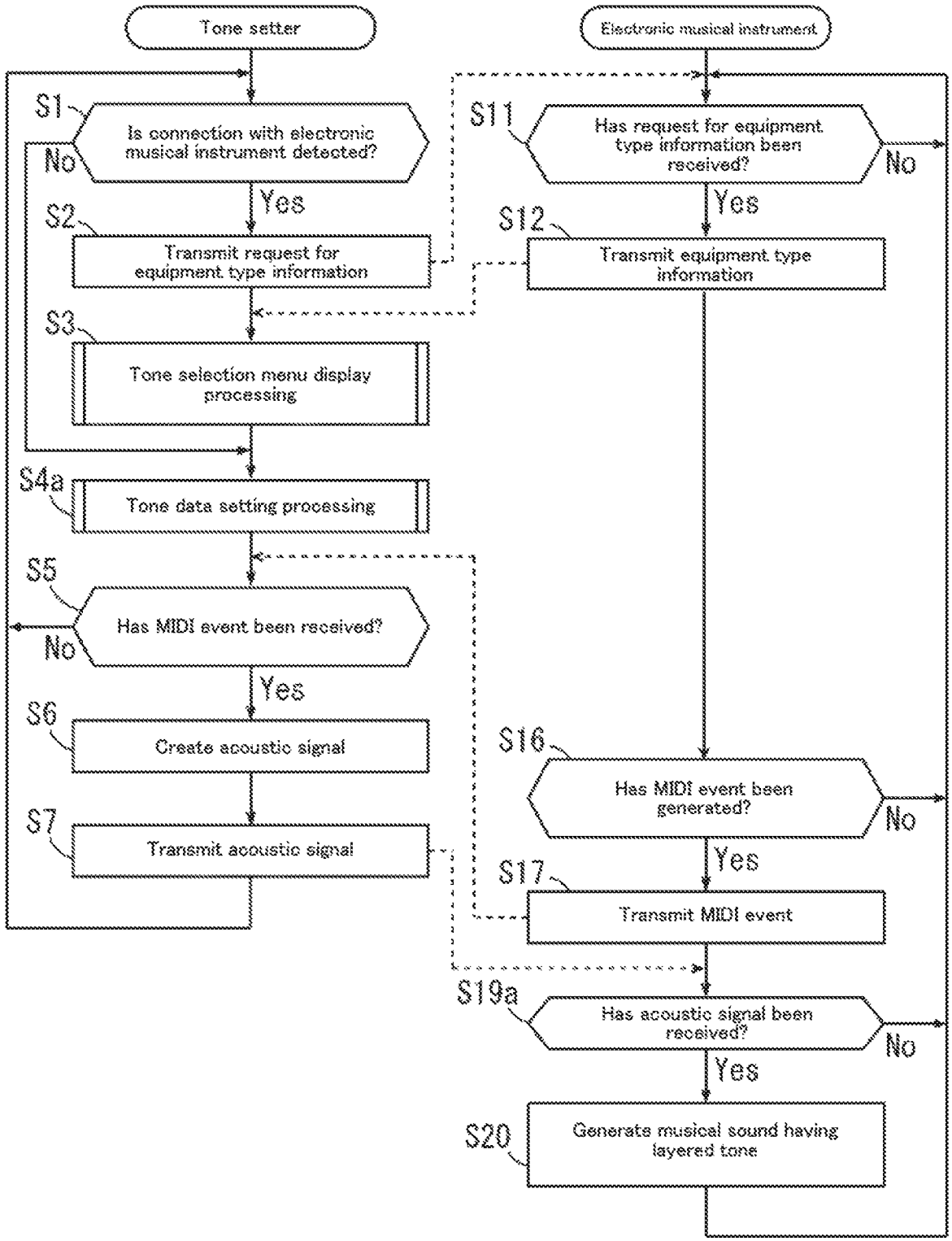
FIG. 9 is a flow chart of tone setting processing when an electronic musical instrument that does not have an internal sound source is connected to the tone setter.
Figure 10:
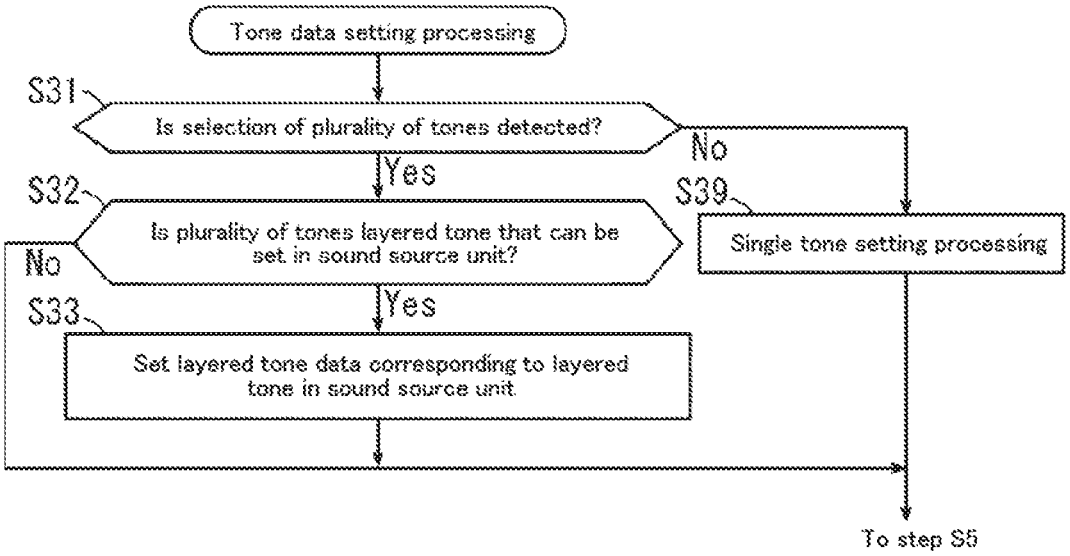
FIG. 10 is a flow chart of tone data setting processing in the tone setting processing in FIG. 9.

FIG. 9 is a flow chart of tone setting processing when an electronic musical instrument that does not have an internal sound source is connected to the tone setter 1. FIG. 10 is a flow chart of tone data setting processing in the tone setting processing of FIG. 9. The tone setting processing illustrated in FIG. 9 differs from the tone setting processing illustrated in FIG. 6 according to the following points. The tone setting processing illustrated in FIG. 9 does not include step S13 to S15 or S18 in FIG. 6, and includes step S4*a* and step S19*a* in place of step S4 and step S19 respectively in FIG. 6. The tone data setting processing of step S4*a* in FIG. 9 is illustrated in FIG. 10. The tone data setting processing in FIG. 10 includes steps S31 to S33 in FIG. 8 and does not include steps S34 to S38 in FIG. 8.

In the tone data setting processing in FIG. 10, the CPU 18 sets the tone data in the sound source unit 14 in the same way as the tone data setting processing according to the above embodiment (steps S31-S33). Specifically, the CPU 18 determines whether a plurality of tones has been selected (step S31). In the case where a plurality of tones has not been selected, that is, in the case where one tone has been selected (step S31: No), the CPU 18 performs the single tone setting processing (step S39). To the contrary, in the case where a plurality of tones has been selected (step S31: Yes), the CPU 18 determines whether the selected plurality of tones is a layered tone that is settable in the sound source unit 14 (step S32). In the case where the plurality of tones selected by the user has been a layered tone that is settable in the sound source unit 14 (step S32: Yes), the CPU 18 functions as the tone setting command providing unit 106 and sets the layered tone data corresponding to the selected layered tone in the sound source unit 14 (step S33). To the contrary, in the case where the selected plurality of tones is a layered tone that cannot be set in the sound source unit 14 (step S32: No), the CPU 18 omits the processing in step S33 and advances the processing to the next step S5.

In the case where a MIDI event has been generated in step S16 in FIG. 9 (step S16: Yes), the CPU of the electronic musical instrument transmits the MIDI event to the tone setter 1 (step S17). The CPU of the electronic musical instrument then determines whether an acoustic signal has been received from the tone setter 1 (step S19*a*). In the case where an acoustic signal has been received, the sound generator 35 generates a musical sound having the one or more tones on the basis of the acoustic signal (step S20). The other steps are processed in the same way as the above embodiment.

According to the present example, the user is able to select, from the tone selection menu, one or more tones based on tone data that is settable in the sound source unit 14. As a result, the user is able to generate, with the electronic musical instrument 3, a musical sound having the layered tone prepared in the tone setter 1. Therefore, even if the electronic musical instrument does not have an internal sound source, a wide variety of layered tones can be generated with the electronic musical instrument with a simple operation.

Figure 11:
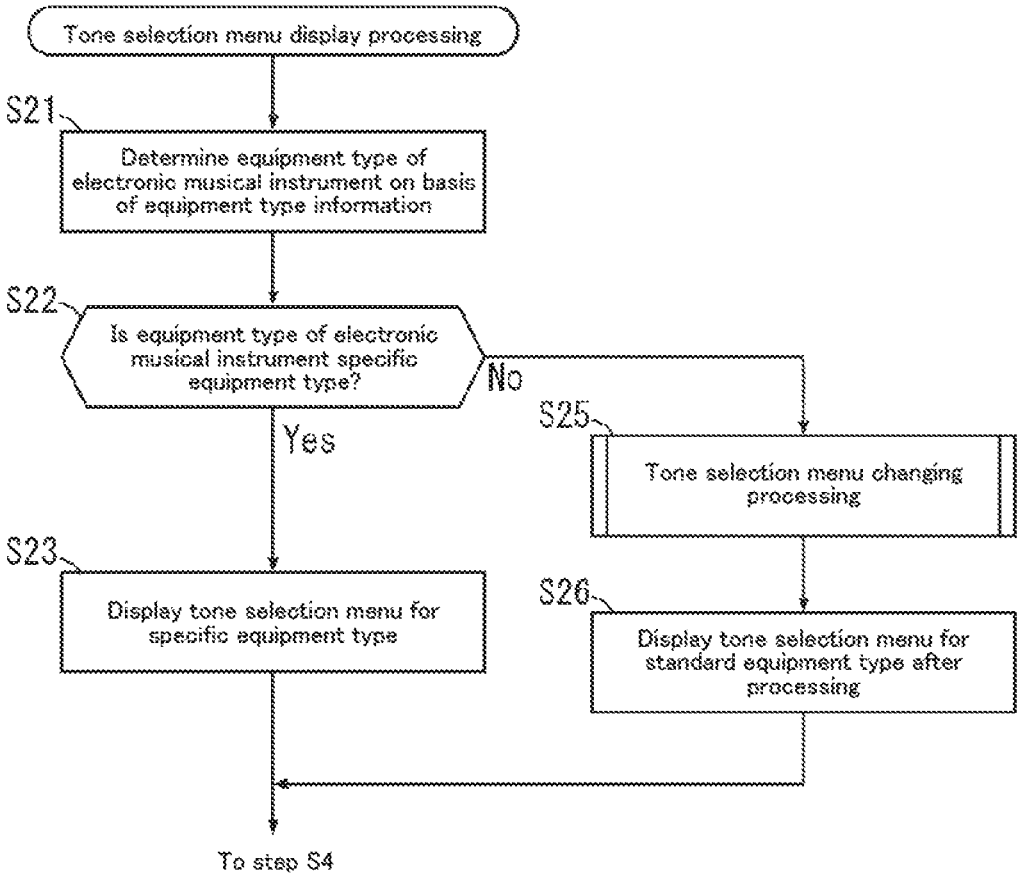
FIG. 11 is a flow chart of another example of the tone selection menu display processing.
Figure 12:
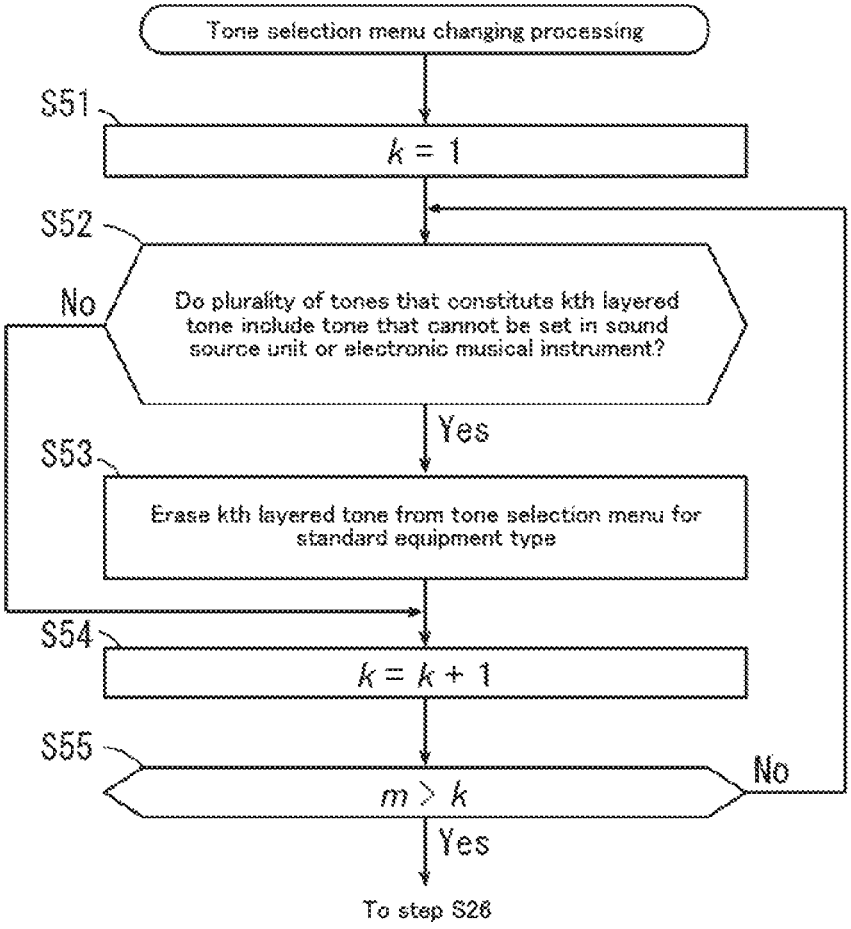
FIG. 12 is a flowchart of changing processing of the tone selection menu in FIG. 11.

(b) FIG. 11 is a flow chart of another example of tone selection menu display processing, and FIG. 12 is a flow chart of changing processing of the tone selection menu in FIG. 11. The tone selection menu display processing in FIG. 11 differs from the tone selection menu display processing in FIG. 7 in that the tone selection menu display processing in FIG. 11 has the steps S25 and S26 in place of step S24 in FIG. 7. In the step S25, changing processing of the tone selection menu is carried out, and in the step S26, the tone selection menu display unit 103 displays, on the display 13 in FIG. 1, the tone selection menu for a standard equipment type after the processing. In the following explanation, the tone selection menu for a standard equipment type includes m number of layered tones.

In the changing processing of the tone selection menu in FIG. 12, the CPU 18 functions as the tone selection menu display unit 103 and sets a variable k to 1 (step S51). Next, the CPU 18 functions as the tone selection menu display unit 103 and determines whether the plurality of tones that constitute the kth layered tone in the tone selection menu for a standard instrument type includes a tone that cannot be set in the sound source unit 14 or the electronic musical instrument 3 (step S52). In the case where the plurality of tones has included a tone that cannot be set in the sound source unit 14 or the electronic musical instrument 3 (step S52: Yes), the CPU 18 functions as the tone selection menu display unit 103 and erases the kth layered tone from the tone selection menu for the standard equipment type (step S53) and adds 1 to the variable k (step S54). To the contrary, in the case where the kth layered tone in the tone selection menu for the standard equipment type is settable in either of the sound source unit 14 and the electronic musical instrument 3 (step S52: No), the CPU 18 omits the processing of step S53 and adds 1 to the variable k (step S54).

Next, the CPU 18 functions as the tone selection menu display unit 103 and determines whether the variable k is greater than m (step S55). In the case where the variable k has been equal to or less than m (step S55: No), the CPU 18 executes the processing from the steps S52 to S54 again. To the contrary, in the case where the variable k has been greater than m (step S55: Yes), the CPU 18 advances the processing to the step S26 in FIG. 11.

The above processing in FIG. 11 and FIG. 12 can be applied to an electronic musical instrument that is not provided with an internal sound source. That is, according to the tone selection menu display processing in FIG. 11 and the changing processing of the tone selection menu in FIG. 12 in the present modified example, the CPU 18 determines whether or not to accept the layered sound source previously set in response to the presence or absence of an internal sound source in the electronic musical instrument connected to the tone setter 1, or the tone data that is settable in the internal sound source. As a result, according to the present modified example, a layered tone that cannot be used by the electronic musical instrument 3 connected to the tone setter 1 is not displayed in the tone selection menu for standard equipment types. Accordingly, the present invention is configured so that user is not able to select a layered tone that cannot be used. That is, the operability of the tone selection is improved.

(c) The tone setter 1 in the above embodiment is provided with the performance operator 12 and the sound generator 15. Therefore, a musical sound having various sounds in the same way as the electronic musical instrument 3 can be generated from the sound generator 15 by an operation of the performance operator 12 in the tone setter 1. In this case, the tone setter 1 can be used as an electronic musical instrument. The tone setter 1 may not be provided with the performance operator 12 or the sound generator 15. In this case, the tone setter 1 only has the tone setting function with regard to the electronic musical instrument 3.

(d) While the tone selection menu in FIG. 3 is displayed only when the electronic musical instrument 3 of the specific equipment type is connected to the tone setter 1 in the above embodiment, the tone selection menu in FIG. 3 may be displayed when the electronic musical instrument 3 of a standard equipment type is connected to the tone setter 1.

(e) The internal sound source 34 includes the PCM sound source in the above embodiment. In addition, the sound source unit 14 is able to act as the FM sound source. However, the types of the sound source unit 14 and the internal sound source 34 are not limited to the above examples and may be selected as appropriate in accordance with the embodiment.

(f) The sound generator 35 of the electronic musical instrument 3 generates a musical sound on the basis of an acoustic signal in the above embodiment. However, the device in which the musical sound is generated is not limited to the electronic musical instrument 3, and the sound generator 15 of the tone setter 1 may generate a musical sound on the basis of an acoustic signal, and both the sound generator 35 of the electronic musical instrument 3 and the sound generator 15 of the tone setter 1 may generate a musical sound on the basis of an acoustic signal.

(g) The electronic musical instrument 3 is connected to the tone setter 1 with a USB cable in the above embodiment. However, the connection method of the tone setter 1 and the electronic musical instrument 3 is not limited to the above example. For example, the tone setter 1 and the electronic musical instrument 3 may be connected by wireless communication such as Bluetooth (trademark) or by another wired communication.

(h) The tone setter 1 may be applied to an electronic device such as a personal computer, a smart device, a game device, or the like. While the tone setter 1 according to the above embodiment is realized by hardware such as the CPU 18 and software such as the tone setting program, the configuration elements in the tone setter 1 illustrated in FIG. 2 may be realized by hardware such as an electronic circuit and the like.

INDUSTRIAL APPLICABILITY

The present invention can be utilized in a tone setter and the like for setting tones in an electronic musical instrument.

LIST OF REFERENCE NUMERALS

1 Tone setter
3 Electronic musical instrument
10 Touch panel display
11, 31 Setting operator
12, 32 Performance operator
13, 33 Display
Sound source unit
15, 35 Sound generator
16, 36 RAM
17, 37 ROM
18, 38 CPU
19, 39 Storage device
20, 40 Communication I/F
21, 41 Bus
34 Internal sound source
100 Electronic musical instrument system
101 Connection detecting unit
102 Equipment type determination unit
103 Tone selection menu display unit
104 Sound selection acceptance unit
105 Sound determination unit
106 Sound setting command providing unit
107, 307 Sound data holding unit

108 Sound setting command transmitting unit
109 Sound data editing unit
110 MIDI event receiving unit
111 MIDI event providing unit
112 Acoustic signal transmitting unit
141, 341 Sound source memory
142, 342 Acoustic signal creating unit

The invention claimed is:

1. A tone setter that is connectable to an electronic musical instrument, the tone setter comprising:
a memory for storing a plurality of tone data and a program; and
at least one processor configured to utilize the plurality of tone data, to set a sound source, to execute, in accordance with the program:
accepting a selection of one or more tones by an operation of a user;
setting tone data corresponding to the selected one or more tones, in at least one of the sound source and the electronic musical instrument so that a sound having the selected one or more tones is generatable with the electronic musical instrument;
accepting a selection of a plurality of tones, and
setting layered tone data corresponding to a layered tone or tone data corresponding to each tone in at least one of the sound source and the electronic musical instrument so that sound having a layered sound obtained by combining the selected plurality of tones, is generatable using the electronic musical instrument, wherein
when the layered tone data is settable in the sound source, the at least one processor sets the layered tone data in the sound source.

2. The tone setter according to claim 1, wherein
the selection of the one or more tones includes selecting a previously set layered tone.

3. The tone setter according to claim 2, wherein
the at least one processor is configured to accept the selection of the previously set layered tone when the tone setter is connected to the electronic musical instrument of a specific equipment type.

4. The tone setter according to claim 3, wherein
the at least one processor is configured to determine whether to accept the selection of the previously set layered tone in accordance with presence or absence of an internal sound source of the electronic musical instrument connected to the tone setter, or in accordance with tone data that is settable in the internal sound source.

5. The tone setter according to claim 2, wherein
the at least one processor is configured to determine whether to accept the selection of the previously set layered tone in accordance with presence or absence of an internal sound source of the electronic musical instrument connected to the tone setter, or in accordance with tone data that is settable in the internal sound source.

6. The tone setter according to claim 1, wherein
when tone data corresponding to the selected one or more tones is settable in the sound source, the at least one processor sets the tone data in the sound source.

7. The tone setter according to claim 1, wherein
the electronic musical instrument includes the internal sound source, and
when tone data corresponding to the selected one or more tones is settable in the internal sound source of the electronic musical instrument, the at least one processor sets the tone data in the internal sound source of the electronic musical instrument.

8. A tone setter that is connectable to an electronic musical instrument, the tone setter comprising:
a memory for storing a plurality of tone data and a program; and
at least one processor configured to utilize the plurality of tone data, to set a sound source, and to execute, in accordance with the program:
accepting a selection of one or more tones by an operation of a user; and
setting tone data corresponding to the selected one or more tones, in at least one of the sound source and the electronic musical instrument so that a sound having the selected one or more tones is generatable with the electronic musical instrument, wherein
the electronic musical instrument includes an internal sound source, and
when the at least one processor accepts the selection of a plurality of tones, and the plurality of tone data corresponding to the selected plurality of tones includes first tone data that is settable in the sound source and second tone data that is settable in the internal sound source of the electronic musical instrument, the at least one processor sets the first tone data in the sound source and sets the second tone data in the internal sound source of the electronic musical instrument.

9. An electronic musical instrument system comprising:
an electronic musical instrument; and
a tone setter that is connectable to the electronic musical instrument, wherein
the electronic musical instrument includes:
an operating unit that a user operates for making a sounding instruction, and
a sound generator that is configured so as to generate a sound based on the sounding instruction, and
the tone setter comprises:
a memory for storing a plurality of tone data and a program; and
at least one processor configured to set a sound source by using the plurality of tone data and to execute, in accordance with the program:
accepting a selection of one or more tones by an operation of a user;
setting tone data corresponding to the selected one or more tones, in at least one of the sound source and the electronic musical instrument, so that a sound having the selected one or more tones is generated by the sound generator of the electronic musical instrument;
accepting a selection of a plurality of tones, and
setting layered tone data corresponding to a layered tone or tone data corresponding to each tone in at least one of the sound source and the electronic musical instrument so that sound having a layered sound obtained by combining the selected plurality of tones, is generatable using the electronic musical instrument, wherein
when the layered tone data is settable in the sound source, the at least one processor sets the layered tone data in the sound source.

10. A tone setting method performed with a tone setter that is connectable to an electronic musical instrument, the method comprising the acts of:
accepting a selection of one or more tones by an operation of a user;

setting tone data corresponding to the selected one or more tones, in at least one of a sound source of the tone setter and the electronic musical instrument so that a sound having the selected one or more tones is generatable with the electronic musical instrument;

accepting a selection of a plurality of tones; and setting layered tone data corresponding to a layered tone or tone data corresponding to each tone in at least one of the sound source and the electronic musical instrument so that sound having a layered sound obtained by combining the selected plurality of tones, is generatable using the electronic musical instrument, wherein when the layered tone data is settable in the sound source, the tone setter sets the layered tone data in the sound source.

* * * * *